US008932115B2

(12) United States Patent
Boutaghou et al.

(10) Patent No.: US 8,932,115 B2
(45) Date of Patent: Jan. 13, 2015

(54) ABRASIVE ARTICLES

(75) Inventors: Zine-Eddine Boutaghou, North Oaks, MN (US); Paul S. Lugg, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 117 days.

(21) Appl. No.: 13/876,668

(22) PCT Filed: Oct. 4, 2011

(86) PCT No.: PCT/US2011/054676

§ 371 (c)(1), (2), (4) Date: Mar. 28, 2013

(87) PCT Pub. No.: WO2012/051002

PCT Pub. Date: Apr. 19, 2012

(65) Prior Publication Data

US 2013/0196581 A1 Aug. 1, 2013

Related U.S. Application Data

(60) Provisional application No. 61/393,598, filed on Oct. 15, 2010.

(51) Int. Cl.

| | |
|---|---|
| ***B24D 11/02*** | (2006.01) |
| ***B24D 3/00*** | (2006.01) |
| ***B24D 11/00*** | (2006.01) |

(52) U.S. Cl.

CPC *B24D 11/02* (2013.01); *B24D 3/00* (2013.01); *B24D 3/002* (2013.01); *B24D 11/001* (2013.01)

USPC ..... 451/490; 451/532; 451/539

(58) Field of Classification Search

CPC ..... B24D 11/02; B24D 3/002; B24D 3/00

USPC ..... 451/490, 526–539, 540; 51/291

See application file for complete search history.

(56) References Cited

U.S. PATENT DOCUMENTS

| | | | |
|---|---|---|---|
| 3,041,156 | A | 6/1962 | Rowse |
| 3,314,838 | A | 4/1967 | Erwin |
| 4,311,489 | A | 1/1982 | Kressner |
| 4,314,827 | A | 2/1982 | Leitheiser |
| 4,623,364 | A | 11/1986 | Cottringer |
| 4,652,275 | A | 3/1987 | Bloecher |
| 4,744,802 | A | 5/1988 | Schwabel |
| 4,770,671 | A | 9/1988 | Monroe |
| 4,799,939 | A | 1/1989 | Bloecher |
| 4,881,951 | A | 11/1989 | Wood |
| 4,931,347 | A | 6/1990 | Slovinsky |
| 4,997,461 | A | 3/1991 | Markhoff-Matheny |

(Continued)

FOREIGN PATENT DOCUMENTS

| | | |
|---|---|---|
| WO | WO 86/02306 | 4/1986 |

*Primary Examiner* — Dung Van Nguyen

(74) *Attorney, Agent, or Firm* — Adam Bramwell

(57) ABSTRACT

An abrasive article is provided. The article includes (a) a flexible backing having opposing first and second surfaces; (b) an abrasive layer comprising plurality of abrasive particles disposed on the first surface of the flexible backing; and (c) an adhesive layer comprising load bearing particles and an adhesive matrix, the adhesive layer disposed on the second surface of the polymer layer. At least a portion of the load bearing particles is substantially enveloped in the adhesive matrix and is in contact with the second surface of the polymer substrate.

15 Claims, 2 Drawing Sheets

(56) References Cited

U.S. PATENT DOCUMENTS

| | | | | |
|---|---|---|---|---|
| 5,008,139 | A | | 4/1991 | Ochi |
| 5,009,675 | A | | 4/1991 | Kunz |
| 5,011,508 | A | | 4/1991 | Wald |
| 5,042,991 | A | | 8/1991 | Kunz |
| 5,085,671 | A | | 2/1992 | Martin |
| 5,201,916 | A | | 4/1993 | Berg |
| 5,213,591 | A | | 5/1993 | Celikkaya |
| 5,251,802 | A | | 10/1993 | Bruxvoort |
| 5,486,427 | A | | 1/1996 | Koskenmaki |
| 5,500,273 | A | | 3/1996 | Holmes |
| 5,897,424 | A | | 4/1999 | Evans |
| 5,924,917 | A | | 7/1999 | Benedict |
| 5,976,000 | A | * | 11/1999 | Hudson ..... 451/534 |
| 6,039,633 | A | * | 3/2000 | Chopra ..... 451/41 |
| 6,217,413 | B1 | | 4/2001 | Christianson |
| 6,645,624 | B2 | | 11/2003 | Adefris |
| 7,044,835 | B2 | | 5/2006 | Mujumdar |
| 7,594,845 | B2 | | 9/2009 | Lugg |
| 7,628,680 | B2 | * | 12/2009 | Kistler et al. ..... 451/41 |
| 2008/0096479 | A1 | * | 4/2008 | Sung ..... 451/539 |
| 2010/0000160 | A1 | | 1/2010 | Lugg |
| 2010/0075578 | A1 | | 3/2010 | Chou |
| 2010/0221545 | A1 | | 9/2010 | Abe |
| 2010/0266812 | A1 | | 10/2010 | Lugg |

* cited by examiner

ABRASIVE ARTICLES

CROSS REFERENCE TO RELATED APPLICATION

This application claims the benefit of U.S. Provisional Patent Application No. 61/393,598, filed Oct. 15, 2010, the disclosure of which is incorporated by reference herein in its entirety.

BACKGROUND

In the lapping and polishing of read/write heads for the hard disk drive (HDD) industry, very hard and very soft, complex materials are typically finished simultaneously. The very soft materials make up the read/write transducer and are located at the edge of the very hard alumina titania carbide (AlTiC) material. Because high pressures are required to remove the hard AlTiC material, high pressures of up to 40 pounds per square inch (psi) are applied. Such a load on the work-piece causes a displacement of the abrasive surface if the abrasive matrix is of sufficiently low modulus. Compression of the abrasive matrix causes displacement and a wave of abrasive material at the edges of the work-piece. The high stresses at the edge of the work piece causes accelerated removal of the edges or what is commonly called "crown" or edge roll off. This crowning effect can damage the transducer that lies at the edge of the work-piece. Multilayer abrasive articles having compliant pressure sensitive adhesives can exacerbate the crown of a read/write head.

FIG. 1 shows a typical prior art system of an abrasive article 10 having abrasive particles 12 dispersed in a binder 13 on a first surface 18*a* of a flexible backing 18 having an adhesive layer 14 coated on a second surface 18*b* of the abrasive article. The adhesive layer, such as, e.g., a pressure sensitive adhesive layer, secures the abrasive article to a rigid support 22. When comparing the various components in the abrasive article 10, the adhesive layer is softer (i.e., having a lower Young's modulus) as compared to the flexible backing and the abrasive particles.

As shown in FIG. 2, in use, typically a work-piece 20 is exposed to the abrasive particles 12 under a load P. Under such circumstances, the work piece and the load applied thereon deform the relatively soft adhesive layer. The flexible substrate tends to follow the deformation of the adhesive layer to cause high stresses at the edges of the work-piece, thereby causing higher material removal rate at the edges of the work-piece. The higher removal rate in turn causes crowning of the work-piece, which is highly undesirable. The edges of the work-piece are rounded due to the high stress caused by the deformation of the underlying adhesive layer and or the deformation of the flexible backing and abrasive particles.

SUMMARY

The present disclosure provides a solution to the problem of crowning, providing a finished work-piece of superior flatness. The abrasive articles provided herein retain the benefits of long life, easy application, easy removal, fine finish and high removal rates with an advance over the art of reduced crown.

In a first embodiment, an abrasive article comprise (a) a flexible backing having opposing first and second surfaces; (b) an abrasive layer comprising plurality of abrasive particles disposed on the first surface of the flexible backing; and (c) an adhesive layer comprising load bearing particles and an adhesive matrix, the adhesive layer disposed on the second surface of the flexible backing, wherein at least a portion of the load bearing particles is substantially enveloped in the adhesive matrix and is in contact with the second surface of the polymer substrate.

In a second embodiment, the abrasive article the first embodiment further comprising a rigid support attached to the adhesive layer comprising the load bearing particles.

In a third embodiment, the abrasive article of any of the preceding embodiment has at least a portion of the load bearing particles is in contact with the rigid support.

In a fourth embodiment, the abrasive article of any of the preceding embodiment has the flexible backing is selected from the group consisting of densified kraft paper, polycoated paper, and polymeric substrate.

In a fifth embodiment, the abrasive article any of the preceding embodiments includes the polymeric substrate selected from the group consisting of polyester, polycarbonate, polypropylene, polyethylene, cellulose, polyamide, polyimide, polysilicone, and polytetrafluoroethylene.

In a sixth embodiment, abrasive article of any of the preceding embodiments includes load bearing particle that is a metal or an alloy thereof selected from the group consisting of tin, copper, indium, zinc, bismuth, lead, antimony, silver and combinations thereof.

In a seventh embodiment, the abrasive article of any of the preceding embodiments includes load bearing particle that is a polymer selected from the group consisting of polyurethane, polymethyl methacrylate and combinations thereof.

In an eighth embodiment, the abrasive article of any of the preceding embodiment includes load bearing particles that is a ceramic material selected from the group consisting of metal oxide and lanthanide oxide.

In a ninth embodiment, the abrasive article of any of the preceding embodiments includes load bearing particles that is a core-shell particle.

In a tenth embodiment, the abrasive article of any of the preceding embodiments includes load bearing particles that are substantially spherical or elliptical in shape.

In an eleventh embodiment, the abrasive article of any of the preceding embodiments includes load bearing particle that has an average diameter that is substantially equal to the thickness of the adhesive layer.

In a twelfth embodiment, the abrasive article of any of the preceding embodiments includes the abrasive particles that are selected from the group consisting of fused aluminum oxide, heat treated aluminum oxide, white fused aluminum oxide, black silicon carbide, green silicone carbide, titanium diboride, boron carbide, tungsten carbide, titanium carbide, diamond, silica, iron oxide, chromia, ceria, zirconia, titania, silicates, tin oxide, cubic boron nitride, garnet, fused alumina zirconia, sol gel abrasive particles, abrasive agglomerates, metal-based particulates, and combinations thereof.

In a thirteenth embodiment, the abrasive article of any of the preceding embodiments includes the abrasive layer that further comprises a binder to bond the abrasive particles to the flexible backing.

In a fourteenth embodiment, the abrasive article of any of the preceding embodiments includes the adhesive matrix that is selected from the group consisting of pressure sensitive adhesives, hot melt adhesives and liquid adhesives that can be cured.

In a fifteenth embodiment, the abrasive article of any of the preceding embodiments further comprising a liner disposed on the adhesive layer.

BRIEF DESCRIPTION OF THE DRAWINGS

The present disclosure can be further defined with reference to the figures, wherein.

DETAILED DESCRIPTION

All numbers used herein are assumed to be modified by the term "about." The recitation of numerical ranges by endpoints includes all numbers subsumed within that range (e.g., 1 to 5 includes 1, 1,5, 2, 2.75, 3, 3.80, 4 and 5). All parts recited herein, including those in the Example section, are parts by weight, unless otherwise indicated.

The abrasive article disclosed herein is designed to deliver very low compression under an applied load. By remaining substantially planar under load this abrasive article produces less roll off or crown at the edges of a work-piece than do conventional abrasive articles with pressure sensitive adhesive attachment system.

Figure 1:
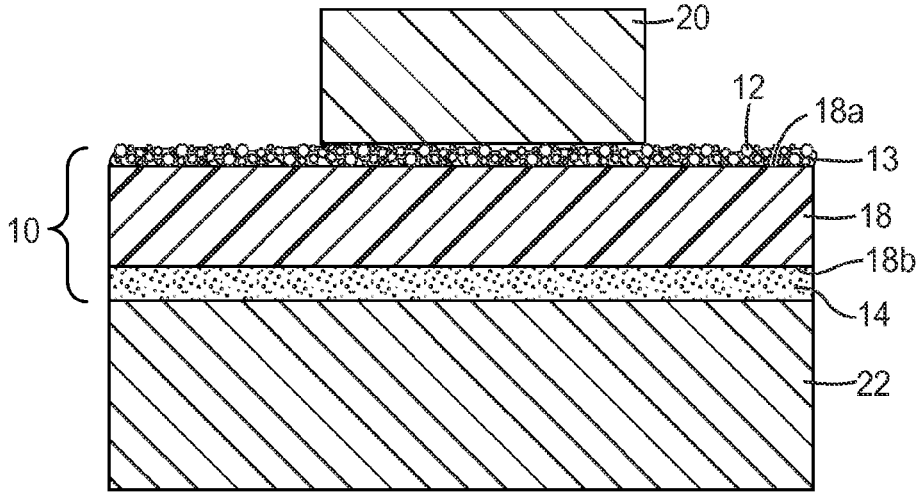
FIG. 1 Prior Art
FIG. 1 is a schematic cross-section representation of a prior art abrasive system.
Figure 2:
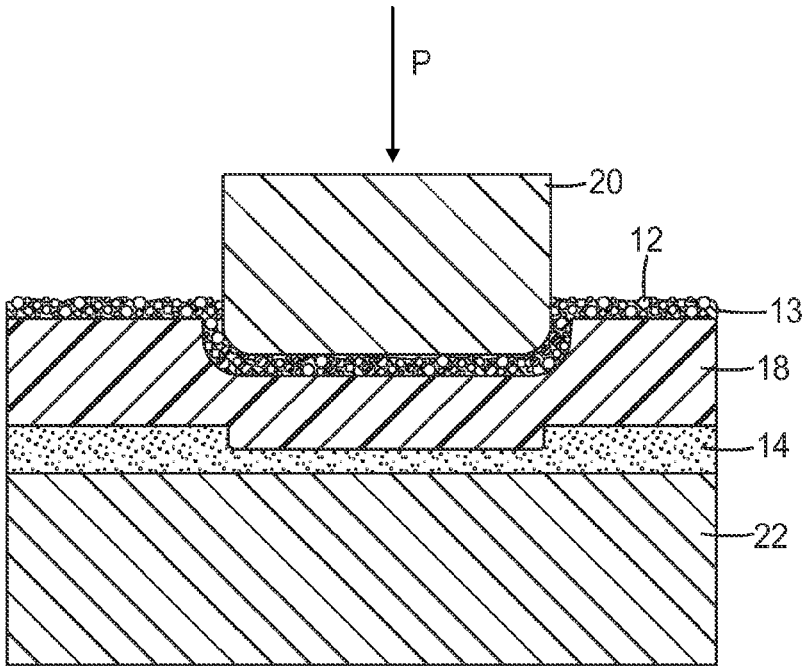
FIG. 2 Prior Art
FIG. 2 is a schematic cross-section representation of the prior art abrasive system of FIG. 1 where a load has been applied to a work-piece.
Figure 3:
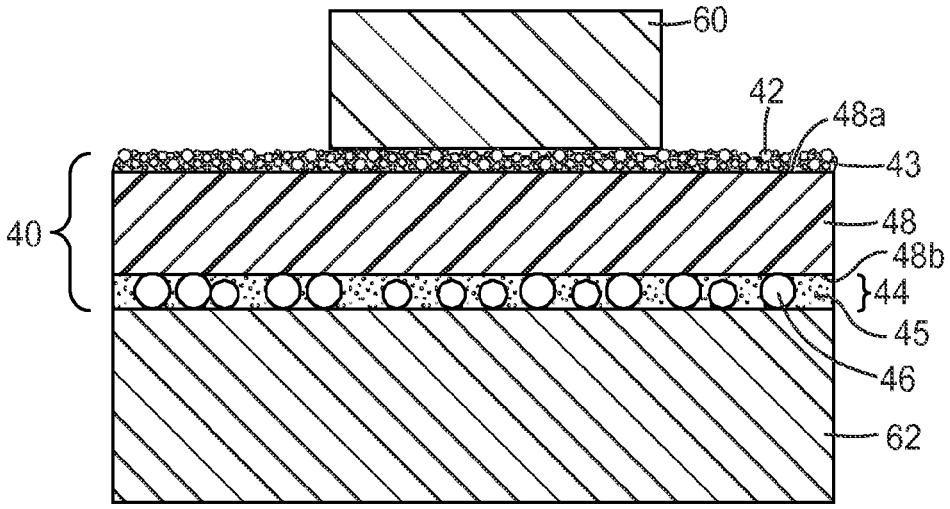
FIG. 3 is a schematic cross-sectional view of one embodiment of an abrasive article of the present disclosure; and The figures are illustrative, are not drawn to scale, and are intended for illustrative purposes.

FIG. 3 shows an illustrative embodiment of the present disclosure. Abrasive article 40 includes a flexible substrate 48 having opposing first 48*a* and second 48*b* surfaces. Abrasive particles 42 are disposed in a binder 43 on the first surface 48*a* of the flexible substrate using binder 43. On the second surface 48*b* of the polymer substrate is disposed an adhesive layer 44 load bearing particles 46 disposed in an adhesive matrix 45. The abrasive article 40 is adhesively attached to a rigid support 62, such as a metal platen. A work-piece 60 is disposed on the abrasive article 40 ready for polishing.

As shown, a portion of the load bearing particles 46 are in direct contact with the second surface 48*b* of the flexible substrate. Furthermore, some of the load bearing particles 46 is in direct contact with the surface of the rigid support 62. Some of the load bearing particles is in direct contact with both the second surface 48*b* of the flexible substrate and the surface of the rigid support 62.

In use, when a load is applied to work-piece, that force is also applied to the abrasive particles 42, to the flexible backing 48 and to the adhesive layer 44. However, instead of the adhesive matrix bearing the load, the load bearing particles function to support the majority of the load thereby minimizing if not eliminating the deformation in the adhesive layer. In order for the load bearing particles to be impactful in minimizing the deformation of the abrasive article, it is believed that at least a portion of the load bearing particles should be in direct contact with the second surface 48*b* of the flexible substrate and in direct contact with the surface of the rigid support. However, it is within the scope of the present disclosure that not the entire load bearing particles is in direct contact with the second surface 48*b* of the flexible backing 44 and the surface of the rigid support 62. In fact, in one embodiment of the present disclosure, a portion of the load bearing particles are in direct contact with at least one of the second surface 48*b* of the flexible substrate and the surface of the rigid support.

Abrasive Particles

Suitable abrasive particles that can be used in the present disclosure include fused aluminum oxide, heat treated aluminum oxide, white fused aluminum oxide, black silicon carbide, green silicon carbide, titanium diboride, boron carbide, tungsten carbide, titanium carbide, diamond (both natural and synthetic), silica, iron oxide, chromia, ceria, zirconia, titania, silicates, tin oxide, cubic boron nitride, garnet, fused alumina zirconia, sol gel abrasive particles and the like. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al).

As used herein, the term abrasive particle also encompasses single abrasive particles bonded together with a polymer, a ceramic, a metal or a glass to form abrasive agglomerates. The term abrasive agglomerate includes, but is not limited to, abrasive/silicon oxide agglomerates that may or may not have the silicon oxide densified by an annealing step at elevated temperatures. Abrasive agglomerates are further described in U.S. Pat. No. 4,311,489 (Kressner); U.S. Pat. No. 4,652,275 (Bloecher et al.); U.S. Pat. No. 4,799,939 (Bloecher et al.), U.S. Pat. No. 5,500,273 (Holmes et al.), U.S. Pat. No. 6,645,624 (Adefris et al.); U.S. Pat. No. 7,044,835 (Mujumdar et al.). Alternatively, the abrasive particles may be bonded together by inter-particle attractive forces as describe in U.S. Pat. No. 5,201,916 (Berg, et al.). Preferred abrasive agglomerates include agglomerates having diamond as the abrasive particle and silicon oxide as the bonding component. When an agglomerate is use, the size of the single abrasive particle contained within the agglomerate can range from 0.1 to 50 micrometer (μm) (0.0039 to 2.0 mils), preferably from 0.2 to 20 μm (0.0079 to 0.79 mils) and most preferably between 0.5 to 5 μm (0.020 to 0.20 mils).

The average particle size of the abrasive particles is less than 150 μm (5.9 mils), preferably less than 100 μm (3.9 mils), and most preferably less than 50 μm (2.0 mils). The size of the abrasive particle is typically specified to be its longest dimension. Typically, there will be a range distribution of particle sizes. In some instances it is preferred that the particle size distribution be tightly controlled such that the resulting abrasive article provides a consistent surface finish on the work piece being abraded.

The abrasive particle may also have a shape associated with it. Examples of such shapes include rods, triangles, pyramids, cones, solid spheres, hollow spheres and the like. Alternatively, the abrasive particle may be randomly shaped.

Yet another useful type of abrasive particle is a metal-based abrasive particle having a substantially spheroid metal containing matrix having a circumference and a super-abrasive materials having an average diameter of less than 50 μm, preferably less than 8 μm, at least partially embedded in the circumference of the metal containing matrix. Such abrasive particles can be made by charging into a vessel, metal-containing matrix (predominantly spheroids), super-abrasive particles, and grinding media. The vessel is then milled for a period of time, typically at room temperature. It is believed that the milling process forces the super abrasive material to penetrate into, attach to, and protrude from the metal containing matrix. The circumference of the metal containing matrix changes from pure metal or metal alloy to a composite of super abrasive and metal or metal alloy. The subsurface of the metal containing matrix near the circumference also contains the super abrasive material, which would be considered as being embedded in the metal containing matrix. This metal-based abrasive particle is disclosed in U.S. Patent Application Publication No. 2010-0000160.

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the adhesion of the abrasive particles in the softened particulate curable binder material. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.).

Flexible Substrate

Suitable flexible substrates that can be used in the present disclosure are typically those known in the abrasive art and are commonly referred to as backings. Suitable flexible substrates include polymeric substrates, e.g. polyester, polycarbonate, polypropylene, polyethylene, cellulose, polyamide, polyimide, polysilicone, and polytetrafluoroethylene; metal foils including aluminum, copper, tin and bronze; and papers, including densified kraft paper and poly-coated paper.

Rigid Substrate

The term "rigid" describes a substrate that is at lease self-supporting, i.e., it does not substantially deform under its own weight. By rigid, it is not meant that the substrate is absolutely inflexible. Rigid substrates may be deformed or bent under an applied load but offer very low compressibility. In one embodiment, the rigid substrates comprise materials having a modulus of rigidity of $1\times10^6$ pound per square inch (psi) ($7\times10^4$ kg/cm$^2$) or greater. In another embodiment, the rigid substrates comprise material having a modulus of rigidity of $10\times10^6$ psi ($7\times10^5$ kg/cm$^2$) or greater.

Suitable materials that can function as the rigid substrate include metals, metal alloys, metal-matrix composites, metalized plastics, inorganic glasses and vitrified organic resins, formed ceramics, and polymer matrix reinforced composites.

In one embodiment, the rigid substrate is substantially flat such that the height difference between its opposing first and second surfaces is less than 10 μm at any two points thereon. In another embodiment, the rigid substrate has a precise, non-flat geometry, such those that can be used for polishing lenses.

Adhesive Matrix

The adhesive matrix provides tack between the flexible backing and the rigid substrate. Any adhesive matrix that can provide tack is suitable for use in the present disclosure. At some point during the formation of the adhesive layer, the adhesive matrix needs to exhibit sufficient flow characteristics such that at least a portion of the load bearing particles is substantially enveloped in the adhesive matrix.

Suitable adhesives for the adhesive matrix include, pressure sensitive adhesives (PSAs), hot melt adhesives and liquid adhesives that can be cured and/or vitrified by ordinary means including, radiation curable, e.g. photo curable, UV curable, E-beam curable, gamma curable; heat curable, moisture curable, and the like. Hot melt adhesives are those adhesives that can flow upon heating at a temperature above the glass and/or melting transition temperature of the adhesive. Upon cooling below the transition temperature, the hot melt adhesive solidifies. Some hot melt adhesive may flow upon heating and then solidify due to further curing of the adhesive.

Load Bearing Particles

The load bearing particles useful for the present disclosure can be metal-based, polymer-based, or ceramic-based, including glasses. They may be hollow, solid or porous. Preferably, a single type of particle is used, however, mixtures of particle types can also be employed.

Suitable metal-based load bearing particles include tin, copper, indium, zinc, bismuth, lead, antimony, and silver, and alloys thereof, as well as combinations thereof. Typically, the metal particles are ductile. Exemplary metal particles include tin/bismuth metal beads, which are commercially available from Indium Corporation, Utica, N.Y., as tin bismuth eutectic powder under the trade designation "58Bi42Sn Mesh100+200 IPN+79996Y" and copper particles (99% 200 mesh) commercially available from Sigma-Aldrich, Milwaukee, Wis., under catalog no. 20778.

Suitable polymer-based load bearing particles include polyurethane particles and polymethylmethacrylate particles and combinations thereof.

Suitable ceramic-based load bearing particles include any of the know metal oxides or lanthanide oxides such as but not limited to zirconia, silica, titania, chromium, nickel, cobalt, and combinations thereof.

The particles may also include core-shell type particles, wherein a first material is coated with at least a second material, e.g. metalized glass particles and metalized polymer particles.

In one embodiment, the load bearing particles are uniformly distributed within the adhesive layer. In another embodiment, the load bearing particles are deformable spheres or elliptically shaped particles to allow for further comply with the flexible substrate profile when the abrasive article is under a load applied to the work-piece. In one embodiment, the load bearing particles, once deformed under the load applied to the work-piece, remain in their deformed condition after the load has been removed. It is believed that the deformation of the load bearing particles cause the adhesive matrix to be displaced from the contact area between the rigid support and the flexible backing. Thus, a balance between the applied load and the amount of deformation experienced in the load bearing particles is reached.

In some embodiments, the Young's modulus of the load bearing particle may be greater than twice that of the adhesive matrix, greater than 10 times that of the adhesive matrix or even greater than 100 times that of the adhesive matrix. In some embodiments, the Young's modulus of the load bearing particles may be greater than 100 MPa, greater than 500 MPa or even greater than 1 GPa.

Method of Making

The abrasive article disclosed herein can be made using various different processes. In one process, an abrasive sheet (e.g., a lapping film) is provided with a pressure sensitive adhesive. The load bearing particles are then applied to the adhesive side of the abrasive sheet. In one embodiment, the load bearing particles are applied to the PSA using a gravity feed. In another embodiment, the load bearing particles are electrostatically attracted to a liner and then transferred to the PSA of the abrasive sheet using a liner transfer method as disclosed in U.S. Patent Application Publication No. 2010-0266812.

In another process, the load bearing particles can be applied to an abrasive sheet that does not include a adhesive matrix. Instead, load bearing particles are directly applied to the rigid support using an adhesive matrix. Thereafter the abrasive sheet is attached to the rigid support.

In yet another process, an adhesive layer is prepared with the load bearing particles incorporated into the adhesive matrix to create a transfer adhesive which can be applied to the abrasive sheet, which is then subsequently adhered to the rigid support. Alternatively, the transfer adhesive with the load bearing particles can be attached to the rigid support and the abrasive sheet is thereafter disposed on the rigid substrate.

EXAMPLES

Test Methods

Lapping Procedure

The liner of an abrasive article was removed and the abrasive article was mounted to a flat, annular shaped, aluminum platen having a 16 inch (40.6 cm) outside diameter, an 8 inch (20.3 cm) inside diameter and a 1.5 inch (3.8 cm) thickness, which was fabricated using standard CNC cutting techniques. The abrasive article was trimmed with a knife to fit the dimensions of the platen. The simultaneous lapping of three AlTiC coupons, 2.40 cm×0.20 cm×0.5 cm, was conducted using a lapping tool, a Lapmaster model 15 (available from Lapmaster International LLC, Mount Prospect, Ill.). The platen with abrasive article was mounted to the base of the tool. A 15 cm diameter×1 mm AlTiC wafer was mounted to the top surface of the 5.5 inch (14.0 cm) diameter ring of the Lapmaster model 15 using an adhesive, SCOTCHWELD DP100 two part epoxy adhesive (available from 3M Company, St. Paul, Minn.). Three AlTiC coupons were mounted to the AlTiC wafer surface using the same epoxy adhesive. The coupons were mounted along a 4.5 mm radius of the wafer, being spaced uniformly, i.e. about 120° apart from one another with their length being perpendicular to the radius. The coupons were mounted such that a 2.40 cm×0.20 cm surface was mounted to the wafer. Lapping conditions were 20 rpm head rotation, 40 rpm platen rotation and a lapping time of 3 hours. During the first hour, a 1 kg load was applied to the head; during the second hour, a 4 kg load was applied and during the third hour, a 6 kg load was applied. The AlTiC coupons rotated in a path that was within the outer diameter and inner diameter of the abrasive covered platen. A lapping fluid was used, anhydrous ethylene glycol was dripped onto the platen at a rate of 0.36 g/min throughout the 3 hour process.

Crown Measurement Procedure

Measurement of the flatness of the AlTiC coupons after lapping was conducted using a profilometer, model P16 (available from KLA-Tencor Corporation, Milpitas, Calif.). Four profilometer scans were taken across the 0.2 cm width of each coupon. The four scans were taken at about 0.5 cm increments along the length of the coupon. The crown is defined as the difference between the maximum and minimum height of a given profilometer scan. The twelve measurements taken from the three coupons were then averaged to obtain an average crown value.

Example 1

A sheet, 17 inch (43.2 cm)×17 inch (43.2 cm) of 676xy diamond lapping film having a pressure sensitive adhesive (PSA) and with 0.25 mic (available from the 3M Company) was placed abrasive side down on a 0.25 inch (6.35 mm)×18 inch (45.7 cm)×18 inch (45.7 cm) aluminum plate. Masking tape was applied at the corners of the sheet to temporarily hold the lapping film to the plate. The protective release liner, which was provided with the lapping film, was removed exposing the PSA.

About 30 g of Indalloy #281, 58Bi/42Sn, −500+635 mesh (20 to 25 micron diameter) bismuth-tin eutectic alloy load bearing particles (available from Indium Corporation, Clinton, N.Y.) was placed onto the PSA in a line along one edge of the of the lapping film. The aluminum plate and lapping film were tilted at a 45° angle and tapped gently to allow the load bearing particles to flow over the PSA. The tilt angle was increased in an effort to complete the coverage of the PSA with the load bearing particles. Once completely covered, the sheet was held in a 90° degree angle and tapped to remove excess metal from the PSA. The release liner was reapplied and the surface of the liner backside was rolled by hand with a rubber roller to force the metal powder into the psa. The aluminum plate and abrasive sheet were placed in an air flow through oven and annealed at 70° C. for 17 hours. The plate and abrasive sheet were removed from the oven and allowed to cool. The abrasive sheet was removed from the plate, forming the abrasive article, Example 1. Example 1 was then tested according to the previously described lapping procedure and crown measurements, Table 1, were made according to the previously described crown measurement procedure.

Example 2

Example 2 was prepared as in Example 1, except about 10 g of 22 micron urethane load bearing particles, Art Pearl C-300T (available from Negami Chemical Industrial Company, Nomi-city, Japan) were used in place of the Indalloy #281, 58Bi/42Sn particles. Example 2 was then tested according to the previously described lapping procedure and crown measurements, Table 1, were made according to the previously described crown measurement procedure.

Example 3

Example 3 was prepared identically to Example 1, except about 10 g of polymethylmethacrylate (PMMA) load bearing particles, MX 2000 (available from Soken Chemical and Engineering Company, Ltd., Tokyo, Japan) were used in place of the Indalloy #281, 58Bi/42Sn particles. Example 3 was then tested according to the previously described lapping procedure and crown measurements, Table 1, were made according to the previously described crown measurement procedure.

Example 4

Example 4 was prepared identically to Example 1, except about 10 g of PMMA load bearing particles, MX 1000 (available from Soken Chemical and Engineering Company, Ltd.) were used in place of the Indalloy #281, 58Bi/42Sn particles. Example 4 was then tested according to the previously described lapping procedure and crown measurements, Table 1, were made according to the previously described crown measurement procedure.

Comparative Example C1

Comparative Example C1 was prepared by taking a sheet, 17 inch (43.2 cm)×17 inch (43.2 cm) of 676xy diamond lapping film, with a PSA, 0.25 mic (available from the 3M Company) was die cut to form a 16 inch (40.6 cm) outside diameter×8 inch (20.3 cm) inside diameter annular shaped sheet. Also, no annealing of the abrasive sheet was conducted. Comparative Example C1 was then tested according to the previously described lapping procedure (no trimming of the abrasive sheet was required) and crown measurements, Table 1, were made according to the previously described crown measurement procedure.

TABLE 1

| | Example 1 | Example 2 | Example 3 | Example 4 | Comparative Example C1 |
|---|---|---|---|---|---|
| Crown micro inches (nm) | 0.4 (10.2) | 0.4 (10.2) | 0.4 (10.2) | 0.9 (22.9) | 1.7 (43.2) |

The invention claimed is:

1. An abrasive article comprising:

(a) a flexible backing having opposing first and second surfaces;

(b) an abrasive layer comprising plurality of abrasive particles disposed on the first surface of the flexible backing; and (c) an adhesive layer comprising load bearing particles and an adhesive matrix, the adhesive layer disposed on the second surface of the flexible backing, wherein at least a portion of the load bearing particles is substantially enveloped in the adhesive matrix and is in contact with the second surface of the flexible backing.

2. The abrasive article of claim 1 further comprising a rigid support attached to the adhesive layer comprising the load bearing particles.

3. The abrasive article of claim 2, wherein at least a portion of the load bearing particles is in contact with the rigid support.

4. The abrasive article of claim 1, wherein the flexible backing is selected from the group consisting of densified kraft paper, poly-coated paper, and polymeric substrate.

5. The abrasive article of claim 4, wherein the polymeric substrate is selected from the group consisting of polyester, polycarbonate, polypropylene, polyethylene, cellulose, polyamide, polyimide, polysilicone, and polytetrafluoroethylene.

6. The abrasive article of claim 1, wherein the load bearing particle is a metal or an alloy thereof selected from the group consisting of tin, copper, indium, zinc, bismuth, lead, antimony, silver and combinations thereof.

7. The abrasive article of claim 1, wherein the load bearing particle is a polymer selected from the group consisting of polyurethane, polymethyl methacrylate and combinations thereof.

8. The abrasive article of claim 1, wherein the load bearing particles is a ceramic material selected from the group consisting of metal oxide and lanthanide oxide.

9. The abrasive article of claim 1, wherein the load bearing particles is a core-shell particle.

10. The abrasive article of claim 1, wherein the load bearing particles are substantially spherical or elliptical in shape.

11. The abrasive article of claim 10, wherein the load bearing particle has an average diameter that is substantially equal to the thickness of the adhesive layer.

12. The abrasive article of claim 1, wherein the abrasive particles are selected from the group consisting of fused aluminum oxide, heat treated aluminum oxide, white fused aluminum oxide, black silicon carbide, green silicone carbide, titanium diboride, boron carbide, tungsten carbide, titanium carbide, diamond, silica, iron oxide, chromia, ceria, zirconia, titania, silicates, tin oxide, cubic boron nitride, garnet, fused alumina zirconia, sol gel abrasive particles, abrasive agglomerates, metal-based particulates, and combinations thereof.

13. The abrasive article of claim 12, wherein the abrasive layer further comprises a binder to bond the abrasive particles to the flexible backing.

14. The abrasive article of claim 1, wherein the adhesive matrix is selected from the group consisting of pressure sensitive adhesives, hot melt adhesives and liquid adhesives that can be cured.

15. The abrasive article of claim 1 further comprising a liner disposed on the adhesive layer.

* * * * *